US007438186B2

(12) United States Patent
Markson et al.

(10) Patent No.: US 7,438,186 B2
(45) Date of Patent: Oct. 21, 2008

(54) MODULAR PRODUCT DISPLAY SYSTEM

(75) Inventors: Rick Markson, Goshen, NY (US); Jay Weinberg, New City, NY (US); Luigi Taranto, Clifton, NJ (US)

(73) Assignee: Sonoco Development, Inc., Hartsville, SC (US)

( * ) Notice: Subject to any disclaimer, the term of this patent is extended or adjusted under 35 U.S.C. 154(b) by 195 days.

(21) Appl. No.: 11/354,862

(22) Filed: Feb. 16, 2006

(65) Prior Publication Data

US 2007/0187346 A1 Aug. 16, 2007

(51) Int. Cl.
*B65D 5/48* (2006.01)

(52) U.S. Cl. ..... 206/745; 206/45.24; 229/120.01

(58) Field of Classification Search ..... 206/745, 206/750, 45.24, 45.25, 45.26, 45.27, 509; 229/120.01; 220/4.27
See application file for complete search history.

(56) References Cited

U.S. PATENT DOCUMENTS 1,225,705 A * 5/1917 Dyson et al. ..... 206/509
2,110,934 A 3/1938 Kanty
2,131,391 A * 9/1938 Schraffenberger ..... 206/746
2,135,533 A 11/1938 Ringler
3,612,288 A 10/1971 Lesley
3,777,897 A 12/1973 Gray
3,918,576 A 11/1975 Taub
4,015,886 A * 4/1977 Wickenberg ..... 312/107
4,022,328 A 5/1977 Toland et al.
4,311,100 A 1/1982 Gardner et al.
4,385,721 A * 5/1983 Olsen et al. ..... 206/509
D276,777 S 12/1984 Evenson
4,488,652 A 12/1984 Hinton et al.
4,570,805 A 2/1986 Smith
4,705,162 A * 11/1987 Kupersmit ..... 206/745
4,811,837 A * 3/1989 Larizza ..... 206/745
4,825,624 A * 5/1989 Calcerano ..... 206/745
4,871,218 A 10/1989 Swinson
D314,091 S 1/1991 March
5,039,002 A * 8/1991 Spamer ..... 206/459.5
5,040,688 A 8/1991 Martin et al.
5,115,965 A * 5/1992 Girona Alepuz ..... 229/109
5,180,058 A 1/1993 Hu
5,255,801 A 10/1993 Berger
5,269,408 A * 12/1993 Otis et al. ..... 206/288
5,322,172 A 6/1994 Maglione
5,513,745 A 5/1996 Zoltan et al.
5,630,518 A 5/1997 Collins
5,826,732 A 10/1998 Ragsdale
5,899,345 A 5/1999 Fuller et al.
6,109,582 A 8/2000 Repaci et al.
6,247,593 B1 * 6/2001 Ruble ..... 206/509

(Continued)

*Primary Examiner*—Jacob K Ackun, Jr.
(74) *Attorney, Agent, or Firm*—Clausen Miller PC

(57) ABSTRACT

The product display system includes one or more display containers, wherein each display container includes a plurality of panels that are adapted to form an area for holding product to be displayed. Each display container may include one or more container interconnection flaps and one or more apertures adapted to receive the interconnection flaps from another one of the display containers, enabling the plurality of display containers to be coupled together. The system may further include a floor stand adapted to hold the plurality of display containers and/or a tray adapted to receive the plurality of display containers. Each display container in the plurality of display containers may include a mounting mechanism enabling the display container to be hung.

13 Claims, 10 Drawing Sheets

U.S. PATENT DOCUMENTS

| | | | | |
|---|---|---|---|---|
| 6,427,853 | B2 | 8/2002 | Brozak, Jr. | |
| 6,712,227 | B2 | 3/2004 | Blumreich et al. | |
| 6,715,623 | B2 | 4/2004 | Broerman | |
| D493,289 | S | 7/2004 | Klein et al. | |
| 6,905,024 | B1 * | 6/2005 | Cao et al. | 206/461 |
| 6,910,590 | B2 | 6/2005 | Meier | |
| 6,920,985 | B2 | 7/2005 | Chandaria | |
| 6,929,132 | B2 | 8/2005 | Belt | |
| 6,929,133 | B1 | 8/2005 | Knapp, III et al. | |
| 7,044,483 | B2 * | 5/2006 | Robertson et al. | 280/33.998 |
| 7,147,374 | B2 * | 12/2006 | Ajootian | 383/13 |
| 2003/0173318 | A1 | 9/2003 | Rushing | |
| 2004/0040921 | A1 | 3/2004 | Chandaria | |
| 2004/0173669 | A1 * | 9/2004 | Kent | 229/171 |
| 2004/0200787 | A1 | 10/2004 | Chandaria | |
| 2005/0045517 | A1 * | 3/2005 | Holdsworth | 206/509 |

* cited by examiner 80
80
84
84
82

80
80
86

80
88
90
94
92
96

80
98

80
100

80
102

MODULAR PRODUCT DISPLAY SYSTEM

TECHNICAL FIELD

The invention generally relates to product display systems.

BACKGROUND

Marketing can be a significant contributor to the success or failure of a product. For example, in the retail industry, the ability to present products and/or samples to consumers in an attractive and/or readily accessible manner can substantially improve sales. Indeed, a great deal of marketing time and effort is often directed toward product display containers in a wide variety of retail environments such as clothing stores, convenience stores, video rental stores, grocery stores, drug stores, trade shows, etc.

Some product display systems have multi-compartment displays that are permanently attached to one another to display merchandise in a "column" configuration. Since the compartments of these displays are not designed to be detachable, there may be a limited number of applications in which these displays can be used. For example, these displays may be limited to either floor stand deployment or hanging deployment, but typically not both. These displays are often not suitable for countertop use due to the potential for the displays to tip over or size issues. Furthermore, the number of compartments and, therefore, the amount of merchandise that can be displayed is generally fixed, which may further limit their usefulness.

While other approaches to displaying merchandise may make use of individual compartments, a number of difficulties remain. For example, one approach is to use compartments that are individually attachable to a floor stand, wherein the attachment mechanism requires multiple intermediate pieces for assembly. Such an approach may require each compartment to have dedicated hanging pieces. The display may be complicated, time consuming to deploy, and susceptible to lost pieces and/or complicated shipping arrangements. Furthermore, the extra parts required for assembly further increase the bill of materials. Even without a separate floor stand, other approaches to individual product display compartments may make use of separate interconnection pieces, leading to similar drawbacks of the display being complicated, time consuming to deploy, susceptible to lost pieces and/or complicated shipping arrangements, and/or increasing the bill of materials.

SUMMARY OF EMBODIMENTS OF THE INVENTION

Certain embodiments of the invention provide for a product display system comprising a plurality of detachable display containers, where each display container in the plurality of detachable display containers includes at least a first side panel, a second side panel, a back panel and a bottom panel. The back panel extends between the first side panel and the second side panel, and the bottom panel extends between the first side panel and the second side panel. The first side panel, the second side panel, the back panel and the bottom panel are adapted to form an area for holding product to be displayed.

In certain embodiments of the invention, the display containers have integral means for interconnecting one display container to an adjacent display container. For example, a display container may include one or more container interconnection flaps, wherein each container interconnection flap is integral with one of the panels. In one embodiment, the display container may include a first container interconnection flap integral with the first side panel and a second container interconnection flap integral with the second side panel. The container interconnection flaps enable the display container to be coupled to an adjacent display container. The adjacent display container may have slots or other apertures formed in or between one or more of its panels for receiving the interconnection flaps, thereby enabling the two display containers to be coupled together.

In certain embodiments of the invention, the bottom surface of the bottom panel facilitates placement of the display container on a substantially horizontal surface such as a countertop or shelf. In certain embodiments of the invention, the back panel includes a mounting mechanism that enables the display container to be hung.

In certain embodiments of the invention, the product display system comprises a plurality of detachable display containers as described above in combination with a stand, rack, pole, base and/or tray adapted to hold the plurality of detachable display containers. For example, the product display system may comprise a plurality of detachable display containers in combination with a floor stand. The display containers may be held by the floor stand in various ways. For example, the back panel of each display container may include a mounting mechanism that enables the display container to be hung from the floor stand. As another example, each display container may have a floor stand interconnection flap that fits into a corresponding slot or other aperture in the floor stand. Alternatively, each display container may have a slot or other aperture that receives a flap from the floor stand. Alternatively, the floor stand has support panels on which each display container rests. Other ways of mounting the display containers to a floor stand are possible.

The product display system may comprise a plurality of detachable display containers in combination with a tray. The tray may be sized to hold a plurality of detachable display containers for display. The tray may have a bottom surface that facilitates placement of the product display system (e.g., the tray holding a plurality of display containers) on a substantially horizontal surface such as a countertop or shelf. The display containers may be held by the tray in various ways. For example, the display containers may simply fit inside the tray. Other ways of having the tray hold a plurality of display containers are possible, including ways similar to those described above.

The invention may be practiced as a system wherein same display container may be used either as a standalone container, may be connected to one or more other similar containers, may be mounted either alone or with other connected containers to a floor stand or powerwing rack, or may be placed either alone or with other similar containers in a tray. In this way, the display container provides versatility to the marketer or retailer, as the same display container may be displayed in different ways.

Each detachable display container may be constructed of a single sheet of material. That is, for example, the first side panel, second side panel, back panel, bottom panel, and any interconnection flaps of a single detachable display container may all be cut from a single sheet of material. The material may be cardboard, paperboard, or any other suitable material.

Further embodiments, features and aspects of the present invention will become readily ascertainable from the following discussion and are set forth in the appended claims.

BRIEF DESCRIPTION OF THE DRAWINGS

The foregoing and further features and advantages of the invention will become apparent from the following description of embodiments with reference to the accompanying drawings, wherein like numerals are used to represent like elements and wherein.

DETAILED DESCRIPTION

Certain embodiments of the invention provide a modular product display system in which detachable display containers of the system can be used in a wide variety of environments. For example, the detachable display containers may be coupled directly to one another to form an interconnected multi-compartment arrangement that can stand alone, can be hung from a rack, can be attached to a floor stand, can be placed in a tray, and so on. The detachable display containers may also be used individually, with each individual display container in a hanging or floor stand configuration, positioned individually on a counter top or shelf, or disposed side-by-side in a tray for shipping and/or retail use. The highly adaptable nature of the modular product display system therefore provides a number of advantages over conventional approaches.

Figure 1:
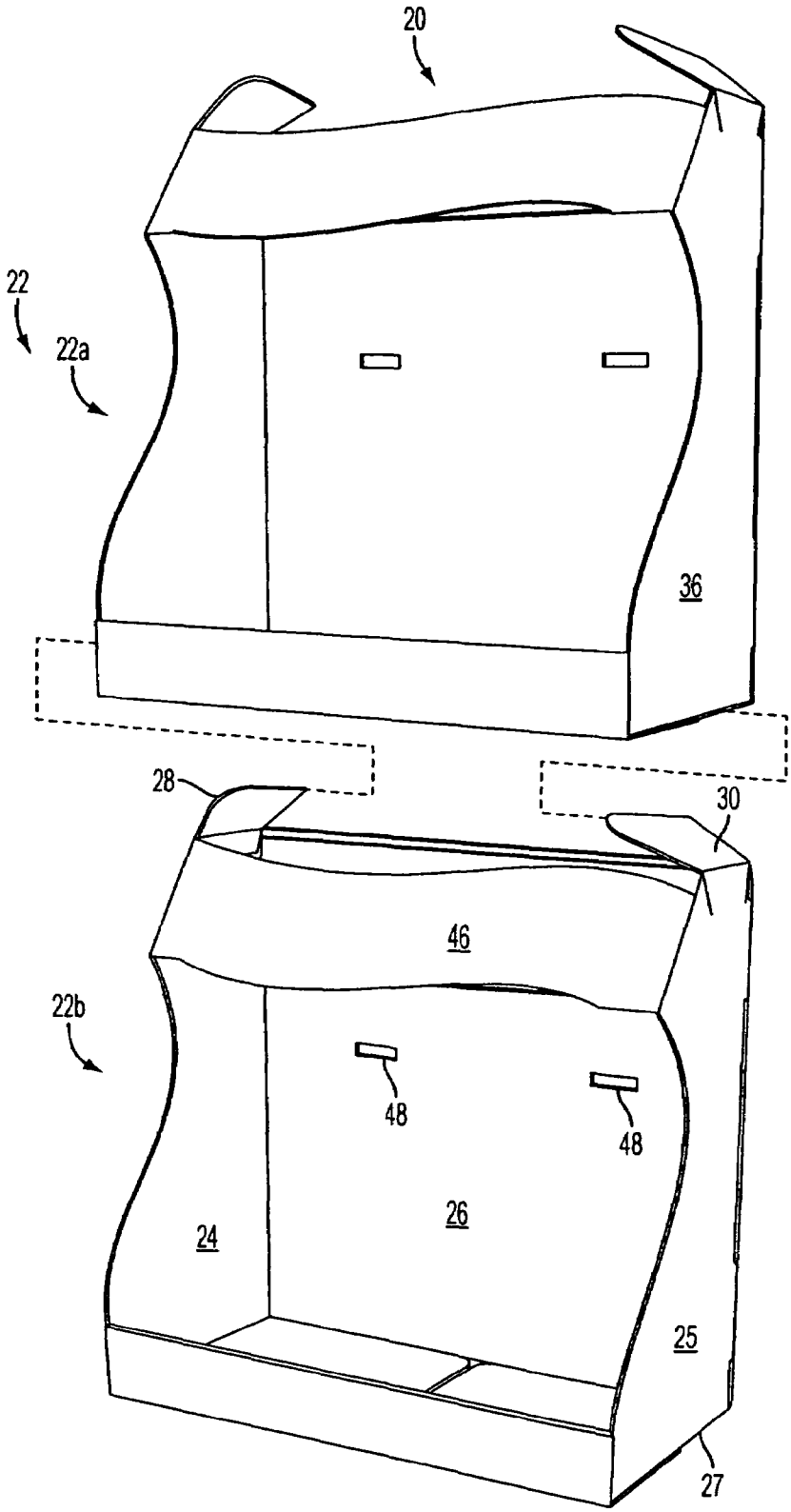
FIG. 1 is a perspective view of an example of a product display system according to an embodiment of the invention.

FIG. 1 shows a modular product display system 20 having a plurality of detachable display containers 22 (22A-22B), wherein each display container 22 includes a plurality of panels that are adapted to form an area for holding product to be displayed. For example, each container 22 may be used permanently or temporarily in a "point of purchase" (POP) environment to display and/or dispense items such as candy, shoes, tobacco products, batteries, video cassettes, DVDs and so on. As will be discussed in greater detail, the system 20 can include a greater or lesser number of containers 22 than the number shown, depending upon the particular application.

In the illustrated example, the lower display container 22B, which is identical to the upper display container 22A, has a first side panel 24, a second side panel 25, a back panel 26 extending between the first side panel 24 and the second side panel 25, and a bottom panel 27 extending between the first side panel 24 and the second side panel 25. The display container 22B can also have a front panel 46 extending between the first side panel 24 and the second side panel 25. Any of the panels, including the front panel 46, may include an advertising message or other indicia (not shown). The advertising message can be related to the merchandise to be dispensed from the display container 22B. The bottom surface of the bottom panel 27 can facilitate placement of the display container 22B on a substantially horizontal surface such as a countertop or shelf.

In this embodiment, each illustrated side panel 24, 25 includes a container interconnection flap 28,30 that is integral to the respective side panel. In particular, the illustrated first side panel 24 has a first container interconnection flap 28 that is integral to the first side panel 24, and the second side panel 25 has a second container interconnection flap 30 that is integral to the second side panel 25. The use of one or more container interconnection flaps 28,30 on each of the containers 22 ensures that multiple display containers can be joined together to form a multi-compartment assembly of any desired size. In addition, by making the interconnection flaps 28,30 integral to the side panels 24,25, the modular product display system 20 can have a simplified construction, simplified assembly, reduced bill of materials, and a reduced likelihood of lost pieces during the life cycle of the system 20.

Figure 2:
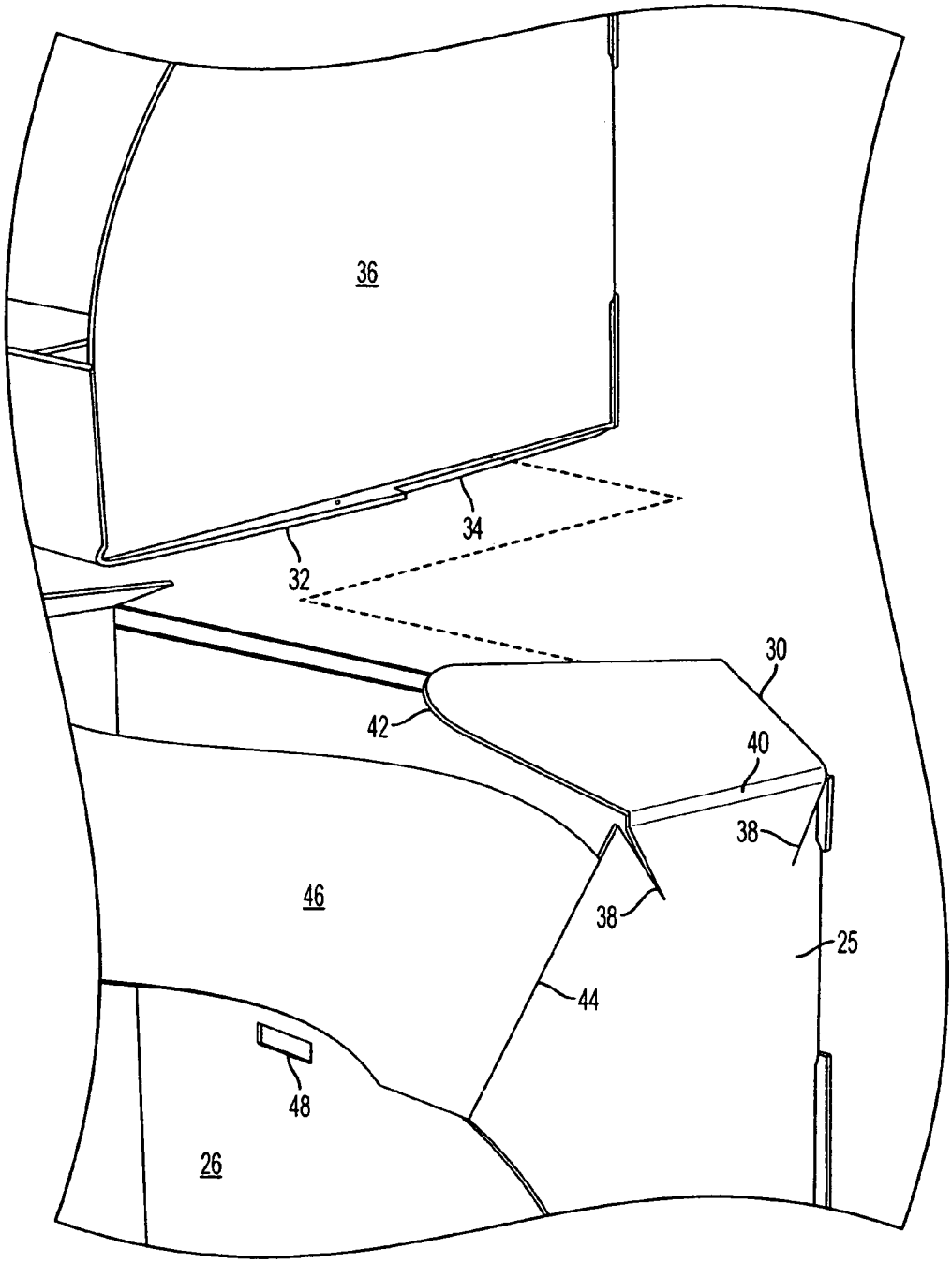
FIG. 2 is an enlarged view of an example of a container interconnection flap and a slot according to an embodiment of the invention.
Figure 3:
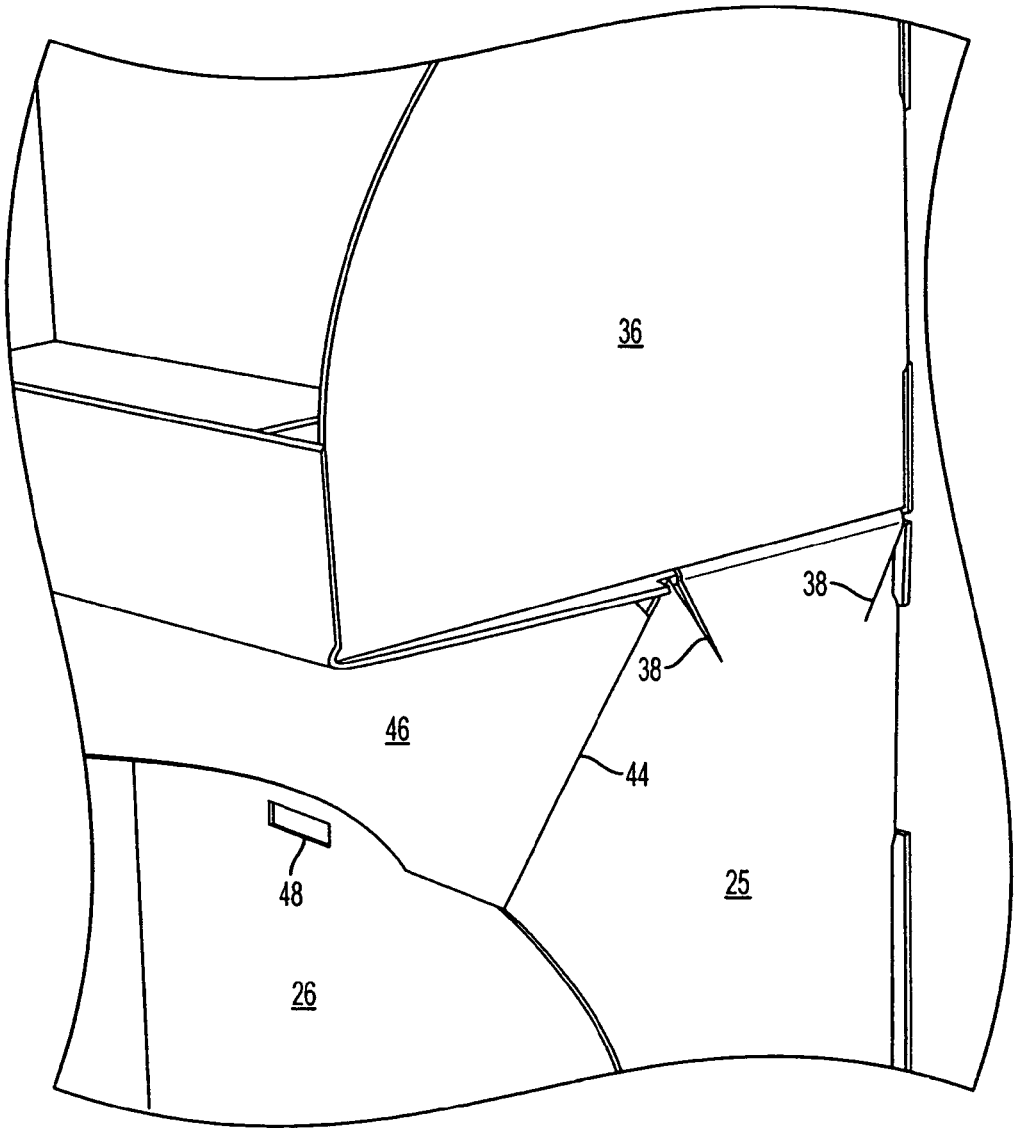
FIG. 3 is an enlarged view of an example of two interconnected display containers according to an embodiment of the invention.

The interconnection mechanism between the product display containers of FIG. 1 is shown in greater detail in FIGS. 2 and 3. In the illustrated example, the upper display container 22A has a slot 34 formed between the bottom panel 32 and the side panel 36, wherein the slot 34 is adapted to receive the interconnection flap 30 of display container 22B, thereby enabling the display containers 22A, 22B to be coupled to one another. When the interconnection flap 30 is assembled fully within the slot 34, the outer edge of the interconnection flap 30 is "flush" with the outermost edge of the bottom panel 32. The interconnection flap 28 may have a similar mating relationship with a slot on the other side of the upper display container 22A. The illustrated interconnection flap 30 also has a fold 40 and angled slits 38 to facilitate mating of the interconnection flap 30 with the adjacent upper display container 22A. In particular, the fold 40 enables the wide portion of the interconnection flap 30 to bend inward with respect to the display container 22B, and the narrowest area of the side panel 25 between the slits 38 provides a temporary fold line for the interconnection flap 30 to bend and flex outward with respect to the display container 22B. It can also be seen that the front crease 44 where the front panel 46 and the side panel 25 intersect can be given a similar angle with respect to the fold 40 as the front edge 42 of the flap 30, so that the interconnection flap 30 can be "tucked" behind the front panel 46 if the interconnection flap 30 of the lower display container 22B is not needed to couple to the lower display container 22B to an adjacent container. The same can be true for the other interconnection flap 28.

The interconnection flaps and slots (or other suitable apertures) can have other configurations. For example, they may be arranged for side-by-side connection as opposed to a stackable connection as illustrated.

The back panel 26 of the illustrated display container 22B also has a mounting mechanism that enables the display container 22B to be hung. In the particular example shown, the mounting mechanism is one or more apertures 48 that are designed to mate with an appropriate mechanism such as a "powerwing" extension hook. The display container 22B may therefore be hung from a substantially vertical structure or surface such as a powerwing rack, pole, mounting strip, etc. Since the upper display container 22A, which also has a mounting mechanism, can be connected directly to the lower display container 22B, the two display containers 22 can both be hung together by using the mounting mechanism of only the upper display container 22A, if desired.

Figure 4:
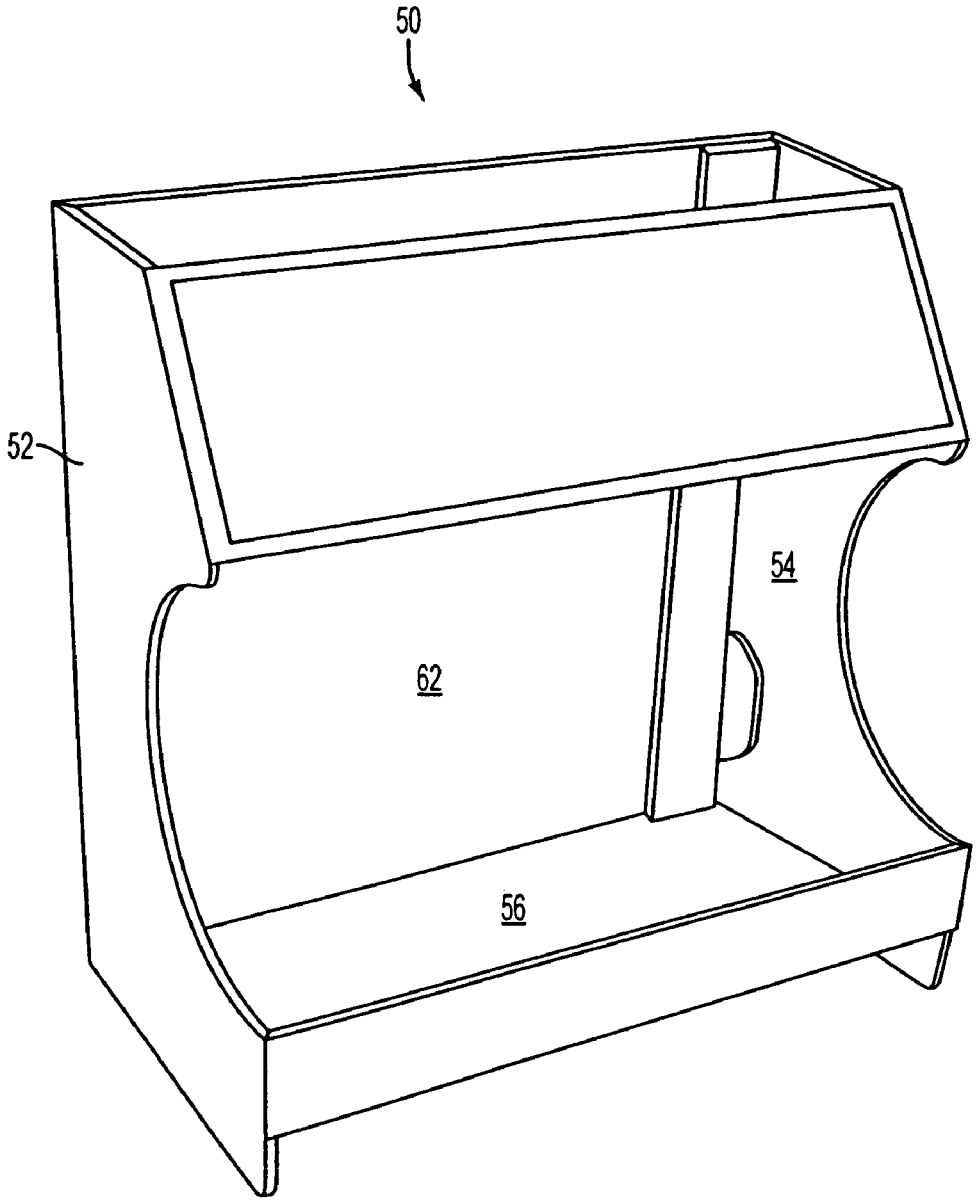
FIG. 4 is a perspective view of an example of a display container according to a second embodiment of the invention.

Turning now to FIG. 4, an alternative display container 50 is shown. In this illustrated example, the container 50 has a bottom surface that facilitates placement of the display container 50 on substantially flat surfaces and is made up of the bottom edge of the first side panel 52 and the bottom edge of the second side panel 54. In this instance, the bottom edges of the side panels 52,54 would contact the countertop, shelf, etc., rather than the bottom surface of the bottom panel 56. Although the display container 50 is not shown as having container interconnection flaps such as flaps 28,30 (FIGS. 1-3), the display container 50 may be readily modified to include these features.

Figure 5:
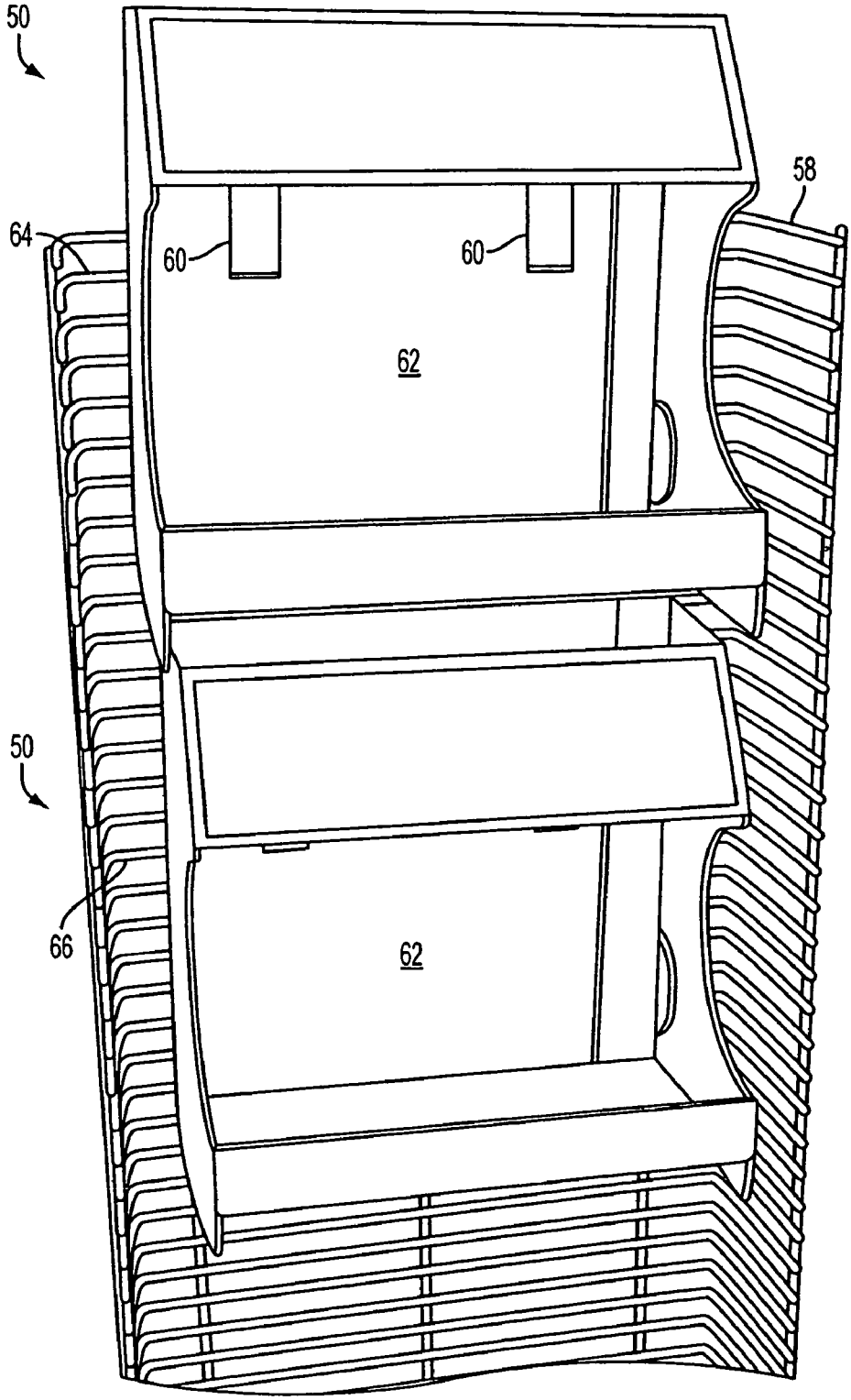
FIG. 5 is a perspective view of an example of two display containers as in FIG. 4, wherein the display containers are mounted to a rack.

FIG. 5 shows that the display containers 50 can each include a mounting mechanism that enables the containers 50 to be hung from a rack 58. In particular, each illustrated display container 50 includes two clips 60, which extend through the back panel 62 and hook over the individual rails of the rack 58. For example, the clips 60 can engage with the rail 64 to hold the upper display container 50 in place. The lower display container can similarly mate with a lower rail of 66 of the rack 58. Accordingly, any number of display containers 50 can be used to display and/or dispense merchandise depending upon the size of the rack 58 and the amount of merchandise to be displayed and/or dispensed.

Figure 6:
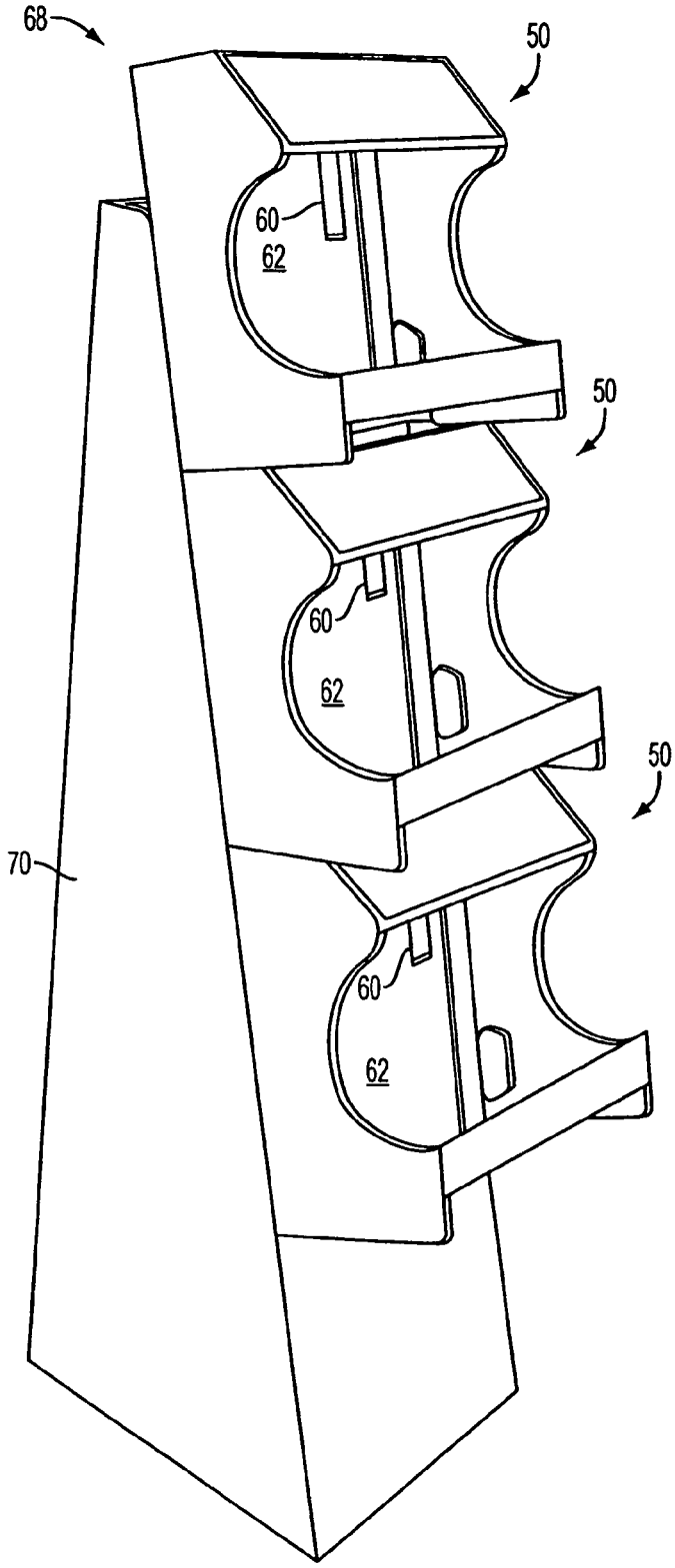
FIG. 6 is a perspective view of an example of three display containers as in FIG. 4, wherein the display containers are coupled to a floor stand.

FIG. 6 shows an alternative configuration 68 in which three product display containers 50 are mounted to a substantially vertical floor stand 70. In this example, the clips 60 of the display containers 50 are inserted through the back panels 62 and into corresponding slots (not shown) in the floor stand 70. As in the rack example (FIG. 5), the number of display containers 50 can vary depend upon the application.

Figure 7:
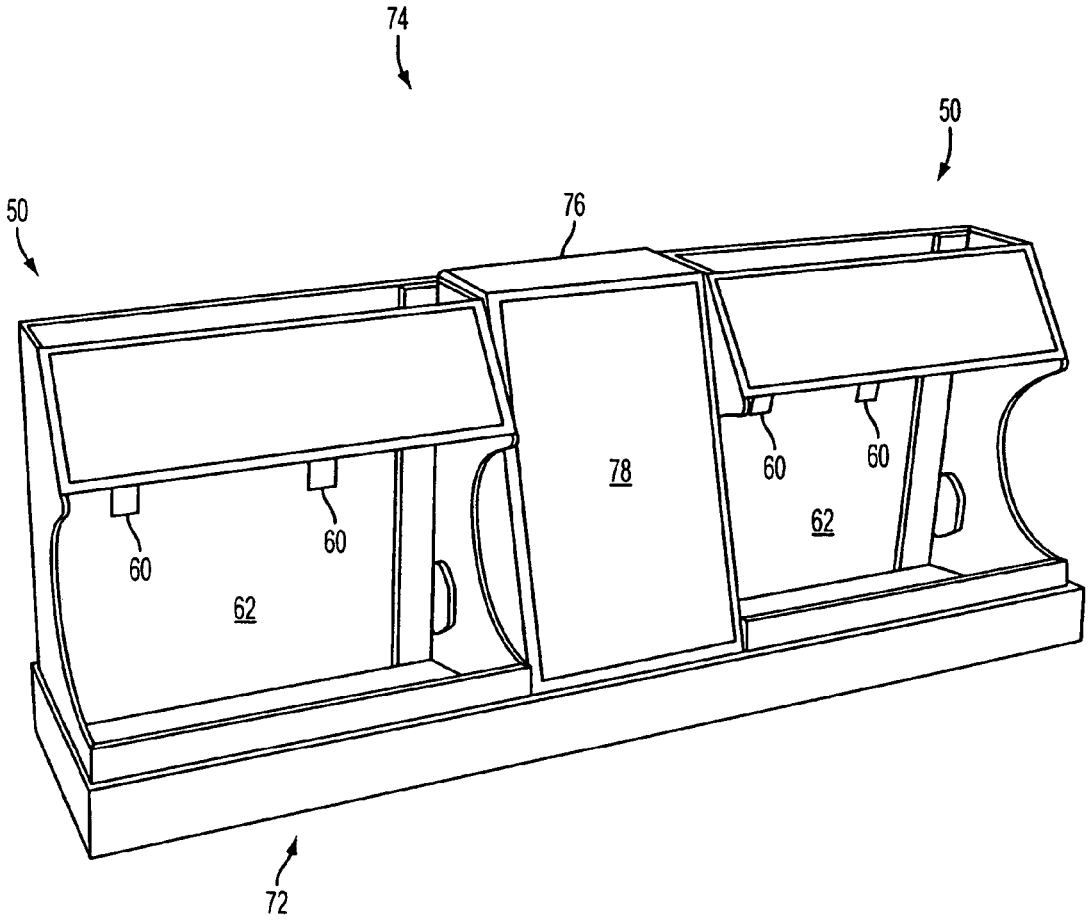
FIG. 7 is a perspective view of an example of two display containers as in FIG. 4, wherein the display containers are disposed within a tray.

FIG. 7 shows another example in which the display containers 50 are arranged in a tray 72. The tray 72 can be used as a "PDQ" display in which the display containers 50, the tray 72 and the merchandise (not shown) to be displayed and/or dispensed are all shipped in the same standard shipping container (not shown). In such a case, when the shipping container arrives at the retail/POP location, the shipping container can be simply cut away from the display assembly 74, wherein the display assembly 74 is then placed in the desired dispensing location. Thus, the retailer does not need to load the merchandise into the display containers 50 or the display containers 50 into the tray 72. Simply put, no assembly is required for the configuration shown. To enhance the visual attractiveness of the display, a divider 76 can also be disposed between the containers 50 in the tray 72, where the forward-facing surface 78 or other areas of the divider 76 can be provided with an advertising message or other indicia. Similarly, the tray 72 may also carry an advertising message or other indicia.

The tray 72 and divider 76 are dimensioned so that the display containers 50 fit snugly within the tray 72. That is, the tray has a bottom panel and four sides defining a containment area, and the containment area is equal to the sum of the areas of the divider(s) and display container(s) to be accommodated.

Turning now to FIGS. 8A-F, various interconnection configurations are shown for an alternative display container 80. Each display container 80 as shown in FIGS. 8A-8F has a horizontally hinged access panel 84 to provide access to the merchandise contained therein. Each display container 80 may include one or more container interconnection flaps 30 (FIGS. 1-3) to facilitate direct interconnection between the display containers 80. Each display container 80 may also include apertures 48 (FIGS. 1-3), clips 60 (FIGS. 5-7), or any other suitable mechanism for hanging the display containers 80, if desired.

Figures 8A, 8B, 8C, 8D, 8E, 8F:
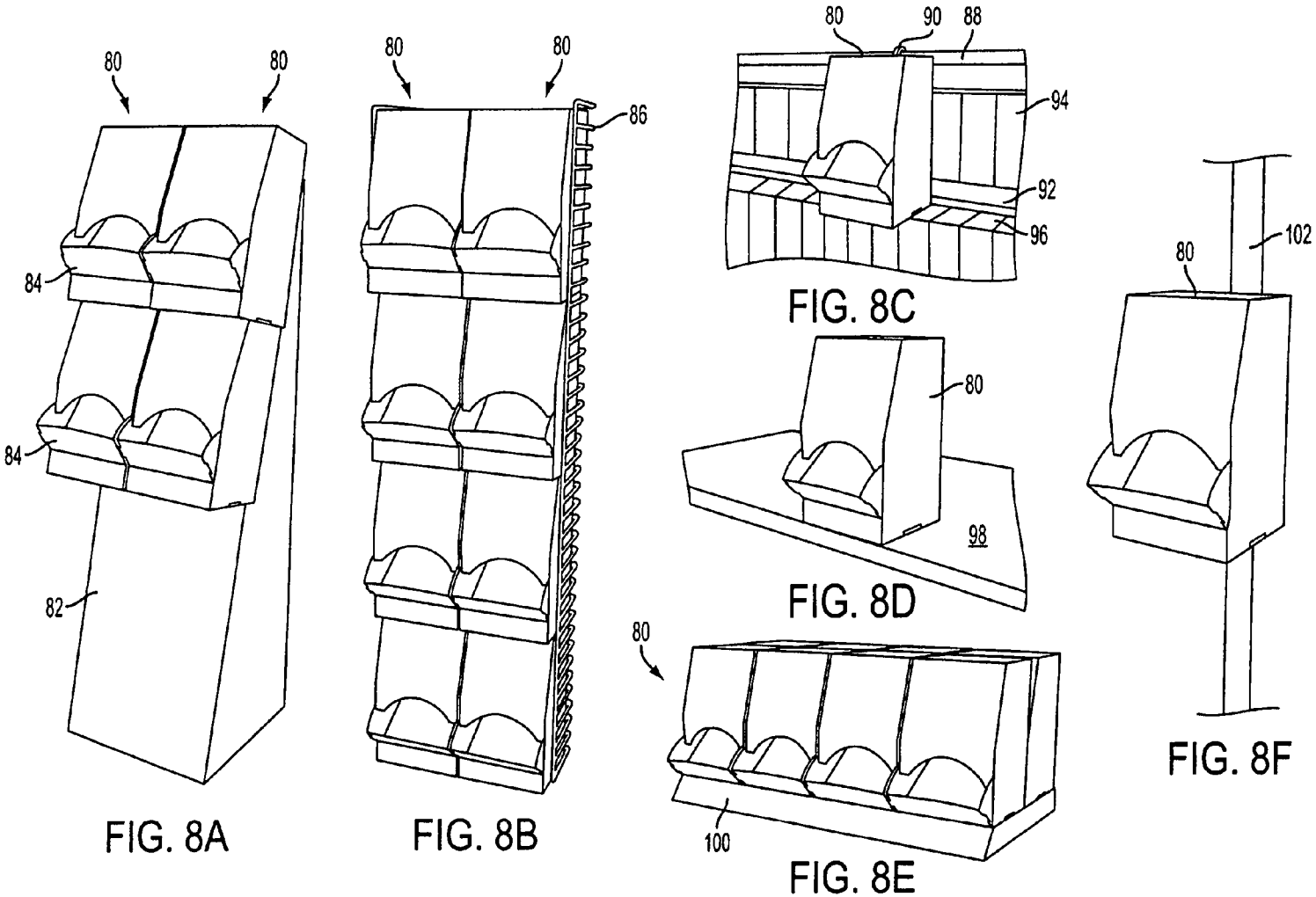
FIGS. 8A-8F are perspective views of examples of display containers according to a third embodiment of the invention.

FIG. 8A shows four display containers 80 being held by a substantially vertical floor stand 82. The display containers 80 may be held by the floor stand 82 in various ways. For example, the back panel of each display container may include a mounting mechanism as described above. Alternatively, each display container 80 may have a flap that fits into a corresponding slot or other aperture in the floor stand 82, or each display container 80 may have a slot or other aperture that receives a flap from the floor stand 82. Alternatively, the floor stand 82 may have support panels on which each display container 80 rests.

FIG. 8B shows eight display containers 80 hung from a rack 86 in an alternative configuration. As already discussed, the display containers 80 can use a variety of mounting mechanisms to couple the containers 80 to the rack 86.

FIG. 8C demonstrates an "inline" approach in which a display container 80 is mounted to a wall strip 88 via a hook 90. A biasing strip 92 can be used to bias the bottom portion of the display container 80 away from the wall 94 so that display container 80 is parallel with the wall 94. The wall 94 may also include a horizontal shelf surface 96 to provide additional support for the display container 80 by contacting the bottom surface of the display container 80.

FIG. 8D shows a display container 80 positioned on a substantially horizontal surface such as a shelf or countertop. Thus, the same display container 80 that can be connected to other display containers and/or mounted to a floor stand or rack may also be used as a standalone display container.

FIG. 8E shows eight display containers 80 being disposed within a tray 100. As discussed with respect to FIG. 7, the tray 100 could be used as a PDQ display in which the tray 100, the display containers 80, and the merchandise (not shown) are all shipped in the same shipping container (not shown) to simplify the merchandise display process. In the illustrated example, two rows of display containers 80 are provided in the tray 100 so that as the first row of display containers 80 is emptied, the second row can be moved forward. The front panel of the tray 100, as well as the various outer surfaces of the display containers 80 can include advertising messages.

FIG. 8F demonstrates that the display container 80 also be mounted to a retail aisle pole 102 in an alternative configuration. In this example, the display container 80 could be provided with a strap to wrap around the pole, or with adhesive to attach to the pole, etc., to hold the display container 80 in place in a temporary or permanent fashion.

It can seen from FIGS. 8A-8F that the modular display container 80 can be used in a wide variety of applications. In this way, the display container provides versatility to the marketer or retailer. The simplified construction and assembly saves time and cost.

Figure 9B:
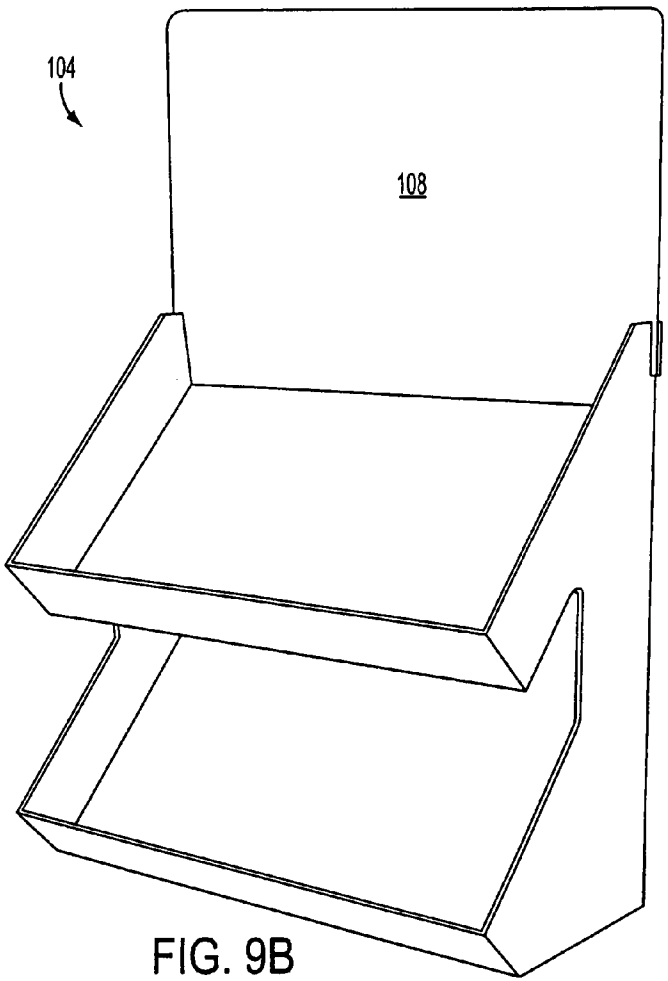
FIGS. 9A-B are perspective views of an example of a product container according to a fourth embodiment of the invention.
Figure 9A:
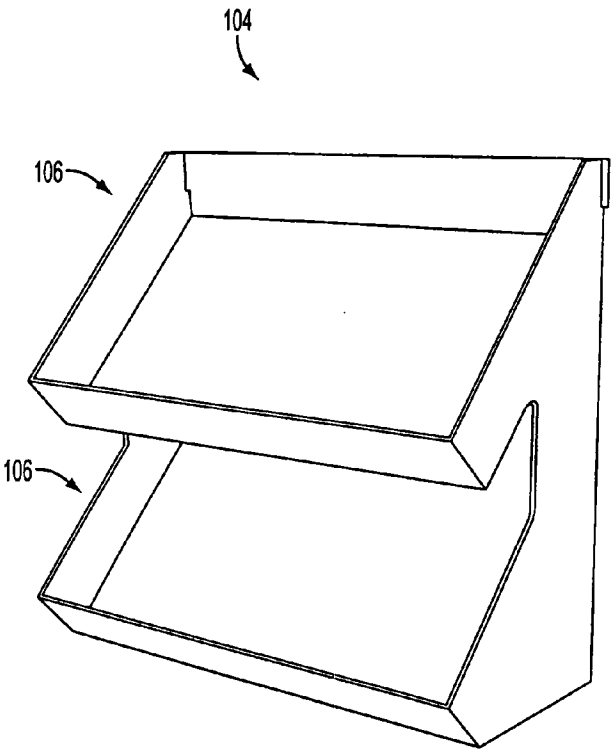

Turning now to FIG. 9A, an alternative product display container 104 is shown. In this example, the container 104 has multiple compartments 106, and the compartments 106 are slanted downward rather than horizontal. In will be appreciated that the display container 104 may be configured to be attached to other display containers 104 (as by flaps and corresponding apertures as described above), either in a side-by-side or stackable configuration.

FIG. 9B shows the display container 104 with a header 108 attached to the upper most portion of the display container 104, where the header 108 can carry larger advertising messages. If stacked with other display containers 104, the header 108 would ordinarily be on the top display container 104.

Figure 10:
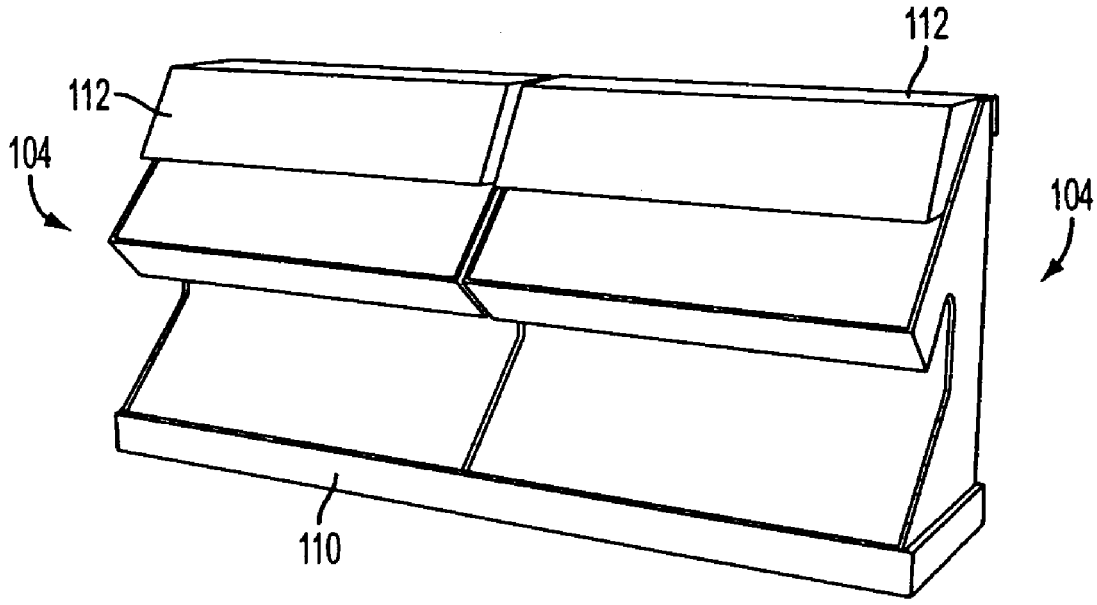
FIG. 10 is a perspective view of an example of two product containers as in FIGS. 9A-B, wherein the product containers are disposed within a tray.

FIG. 10 shows two display containers 104 disposed within a tray 110, wherein the tray 110, display containers 104 and merchandise (not shown) can be combined with a shipping container (not shown). In this illustrated example, each display container 104 has a hood 112 that is adapted to carry advertising messages.

Display containers such as the illustrated modular display containers 22 (FIG. 1-FIG. 3), modular display containers 52 (FIG. 4-FIG. 7), modular display containers 80 (FIGS. 8A-8F), and modular display containers 104 (FIGS. 9 and 10) can be fabricated out of materials such as cardboard, paperboard, or other suitable material, for example by cutting the desired shape from stock material. Each modular display container may be constructed of a single sheet of material. Other materials and techniques are possible, such as manufacturing the containers out of plastic by molding.

The display containers of the various embodiments of the invention may of course take numerous forms other than those in the illustrated examples. For example, in some embodiments, the display container may have only one container interconnection flap. The container interconnection flaps need not extend from the side panels; for example, they may extend from the back panel and/or front panel. In such a case, the bottom panels of the display containers may be provided with slots or other apertures on the front and rearmost portions rather than the side portions in order to mate with the interconnection flaps. Many other variations are possible within the scope of the embodiments of the invention.

It will be appreciated that certain embodiments of the invention provide advantages in terms of simplicity, time savings, and cost savings. Also, a modular approach in which the same or similar display containers are used in various ways (e.g., on shelves, in floor stands, in powerwings, etc.), provides an attractive and effective way to market and sell the products on display.

The term "coupled" is used herein to refer to any connection, direct or indirect, and unless otherwise stated may include a mechanical, electrical, optical, electromagnetic, integral, separate, or other relationship between the components in question. Furthermore, any use of terms such as "first" and "second" do not necessarily infer a chronological relationship.

Although embodiments of the present invention have been disclosed in detail, it should be understood that various changes, substitutions, and alterations may be made herein, and the present invention is intended to cover various modifications and equivalent arrangements. Other examples are readily ascertainable from the above description by one skilled in the art and may be made without departing from the spirit and scope of the present invention as defined by the following claims.

What is claimed is:

1. A product display system comprising:

a plurality of detachable display containers, each display container in the plurality of detachable display containers including at least:

(i) a first side panel;

(ii) a second side panel;

(iii) a back panel between the first side panel and the second side panel; and (iv) a bottom panel between the first side panel and the second side panel;

wherein the first side panel, the second side panel, the back panel and the bottom panel are adapted to form an area for holding product to be displayed;

wherein each display container in the plurality of detachable display containers further includes at least one container interconnection flap extending from one of the side panels and at least one aperture in the form of a slot located between the bottom panel and one of the side panels and adapted to receive at least one interconnection flap from another one of the display containers in the plurality of detachable display containers;

wherein the plurality of display containers are adapted to be coupled together by assembling said at least one container interconnection flap of one display container in said at least one aperture of an adjacent container; and wherein the at least one interconnection flap comprises a first portion connected to a second portion along a fold line, the first portion having a front edge adapted to be received by the aperture, the second portion and the side panel defining a pair of slits therebetween to facilitate mating of the interconnection flap with the adjacent container.

2. The system of claim 1, wherein each display container in the plurality of detachable display containers comprises two container interconnection flaps, with a first container interconnection flap extending from the first side panel and a second container interconnection flap extending from the second side panel.

3. The system of claim 2, wherein each display container in the plurality of detachable display containers comprises two apertures in the form of slots, with a first slot between the bottom panel and the first side panel and a second slot between the bottom panel and the second side panel.

4. The system of claim 1, wherein each display container in the plurality of detachable display containers further includes a front panel extending between upper portions of the first side panel and the second side panel, the front panel and the first and second side panels defining a top and sides of a window through which the product can be viewed.

5. The system of claim 1, further including a tray having an upper surface that engages with the bottom surface of each bottom panel, wherein the tray is dimensioned to received the plurality of detachable display containers so that they take up all available room within the tray.

6. The system of claim 5, further including a shipping container, wherein the shipping container includes the plurality of display containers and the tray.

7. The system of claim 1, further including a tray having an upper surface that engages with the bottom surface of each bottom panel, and further including a set of one or more dividers, wherein the tray is dimensioned to received the plurality of detachable display containers and the set of one or more dividers so that they take up all available room within the tray.

8. The system of claim 7, further including a shipping container, wherein the shipping container includes the plurality of display containers and the tray and one or more dividers.

9. The system of claim 1, further including a floor stand on which the display containers can be mounted.

10. The system of claim 1, wherein each display container in the plurality of detachable display containers further includes a mounting mechanism on the back panel, enabling the display container to be hung.

11. The system of claim 4 wherein the front panel is affixed to the upper portions of the first side panel and the second side panel along front creases that are angled outwardly away from the back panel.

12. The system of claim 11 wherein the system comprises top and bottom vertically stacked display containers, the bottom panel of the top display container cantilevered over the interconnecting flaps of the bottom display container.

13. The system of claim 11 wherein the interconnection flap is configured such that it can be tucked behind the front panel and held securely in that position by the front panel.

* * * * *